United States Patent [19]

Dennis

[11] Patent Number: 4,870,999

[45] Date of Patent: Oct. 3, 1989

[54] PROCESS FOR FORMING EMBLISHED FABRIC BY CORE YARN REMOVAL

[76] Inventor: Linda H. Dennis, 130 Applewood La., Spartanburg, S.C. 29302

[21] Appl. No.: 293,560

[22] Filed: Jan. 3, 1989

[51] Int. Cl.[4] ..... D03D 13/00

[52] U.S. Cl. ..... 139/383 R; 112/266.1; 139/416

[58] Field of Search ..... 112/400, 415, 416, 417, 112/420, 429, 430, 439, 440, 441, 266.1; 2/243 R, 243 B; 5/434, 490, 491, 420, 442, 436, 437; 139/383 R, 384, 385, 416, 426 R; 434/95

[56] References Cited

U.S. PATENT DOCUMENTS

| | | | |
|---|---|---|---|
| 361,360 | 4/1887 | Hunt | 139/383 R |
| 378,952 | 3/1888 | Buntrock | 5/491 |
| 385,772 | 7/1888 | Owen | 112/439 |
| 399,182 | 3/1889 | Campbell | 112/440 |
| 823,421 | 6/1906 | Loeb | 112/439 X |
| 1,203,561 | 11/1916 | Aaron | 112/416 |
| 1,446,808 | 2/1923 | Moore | 112/429 |
| 2,401,830 | 6/1946 | Kahil | 112/415 X |
| 2,585,946 | 2/1952 | Liberman | 434/95 |
| 2,916,798 | 12/1959 | Caputa et al. | 112/415 X |
| 3,968,530 | 7/1976 | Dyson | 5/436 |
| 4,222,125 | 9/1980 | Sewell-Wood | 2/243 B X |
| 4,465,007 | 8/1984 | Strobel | 112/439 |
| 4,516,609 | 5/1985 | Dennis | 139/383 R |
| 4,530,665 | 7/1985 | Colonel | 112/439 X |

FOREIGN PATENT DOCUMENTS

| | | | |
|---|---|---|---|
| 278524 | 9/1914 | Fed. Rep. of Germany | 5/434 |
| 134583 | 8/1929 | Switzerland | 112/429 |

*Primary Examiner*—Andrew M. Falik

*Attorney, Agent, or Firm*—John B. Hardaway; Ralph Bailey

[57] ABSTRACT

A craft fabric process wherein a fabric edge has a discontinuity formed by a core yarn which is replaced with an embellishment woven through the discontinuity formed by the removal of the core yarn.

1 Claim, 3 Drawing Sheets

PROCESS FOR FORMING EMBLISHED FABRIC BY CORE YARN REMOVAL

This application is a continuation of application Ser. No. 119,250, filed 11/2/87, now abandoned, which is a continuation of No. 015,587, filed 2/17/87, now abandoned, which is a continuation of No. 755,866, filed 7/17/85, now abandoned.

BACKGROUND OF THE INVENTION

This invention relates generally to the art of home crafts and more particularly to a fabric for embellishment by hand.

Many fabric items have been successfully marketed for needle and thread handwork. Amongst those items are fabric designed for counted cross stitch, stenciled fabrics for needlepoint as well as other items designed for needle and thread embellishment. One such product is described in my issued U.S. Pat. No. 4,516,609.

The actual act of needle and thread embellishment has proved to be very enjoyable for many craft individuals. The utilization of the completed article, however, is frequently a difficult task. One such utilization has been the needle and thread embellishment of a pillow top and then forming such pillow top into a pillow utilizing machine sewing in a conventional manner.

Frequently flat embellished fabric has been framed for display at the completion of the embellishment step.

While all of these products and procedures have been beneficial to people involved in crafts, there exists a need for new and more diverse crafts fabrics.

SUMMARY OF THE INVENTION

It is thus an object of this invention to provide a novel fabric for needle and thread embellishment.

It is a further object of this invention to provide such a fabric which may be hand crafted into a final article. It is a still further and more particular object of this invention to provide a craft fabric which may be embellished and utilized to form a pillow without need for machine sewing.

These, as well as other objects, are accomplished by a craft item formed of a woven flat fabric in the form of a square or rectangle with discontinuities near each edge to define areas for hand embellishment about a central square or rectangle defined by the discontinuities.

DETAILED DESCRIPTION

In accordance with this invention it has been found that a generally square or rectangular piece of fabric with discontinuities along the edges thereof which are parallel to and coextensive with the adjoining edge, provides a craft item which may be finished into a final article without need for machine handling. Various other advantages and features will become apparent from a reading of the following description given with reference to the various figures of drawing.

Figure 1:
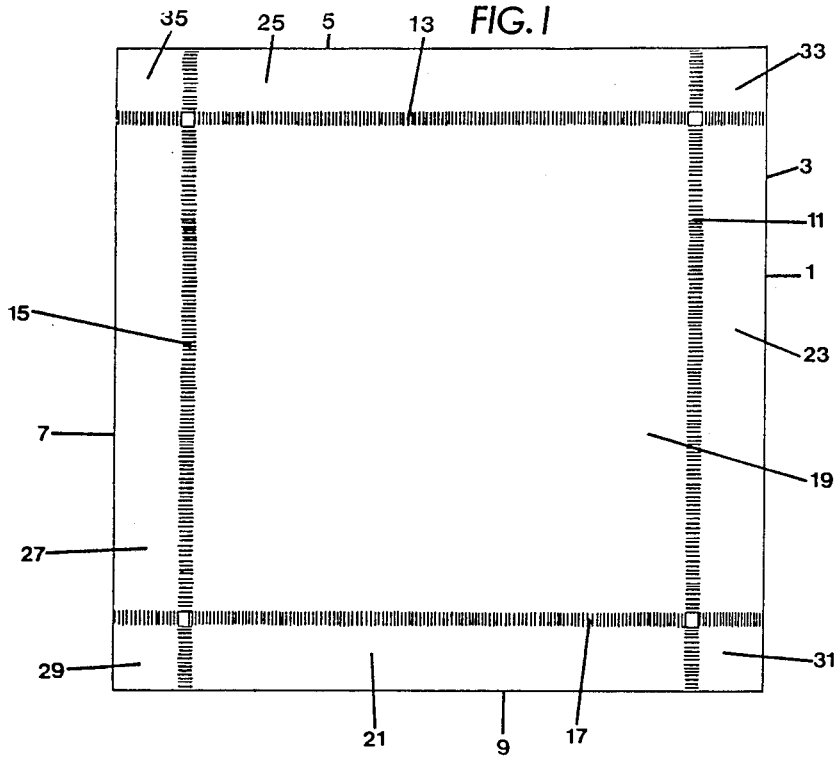
FIG. 1 of the drawings illustrates in plan view a fabric in accordance with this invention.

FIG. 1 of the drawings illustrates a fabric 1 in accordance with this invention. The fabric 1 is generally in the form of a square or rectangle and for purposes of reference generally has edged dimensions of from about 4 to 20 inches. The fabric 1 has four edges 3, 5, 7, and 9. Each edge has associated therewith a discontinuity 11, 13, 15, and 17. The discontinuity is coextensive with and parallel to its associtaed edge. It is seen that the discontinuities define a central square or rectangle 19 within the center portion of the fabric 1. The discontinuities thus define along each edge a border 21, 23, 25 and 27 and adjoining squares 29, 31, 33 and 35. The combination of borders and squares around the perimeter of fabric 1 forms a frame about the central square or rectangle 19. Since it is preferred that all border areas be of equal width, the central square or rectangle will earn generally be in the same shape as the fabric 1 but with reduced dimensions. Thus, for purposes of reference, when the central square or rectangle is referred to it is generally that central portion of the fabric delineated by discontinuities.

Figure 2:
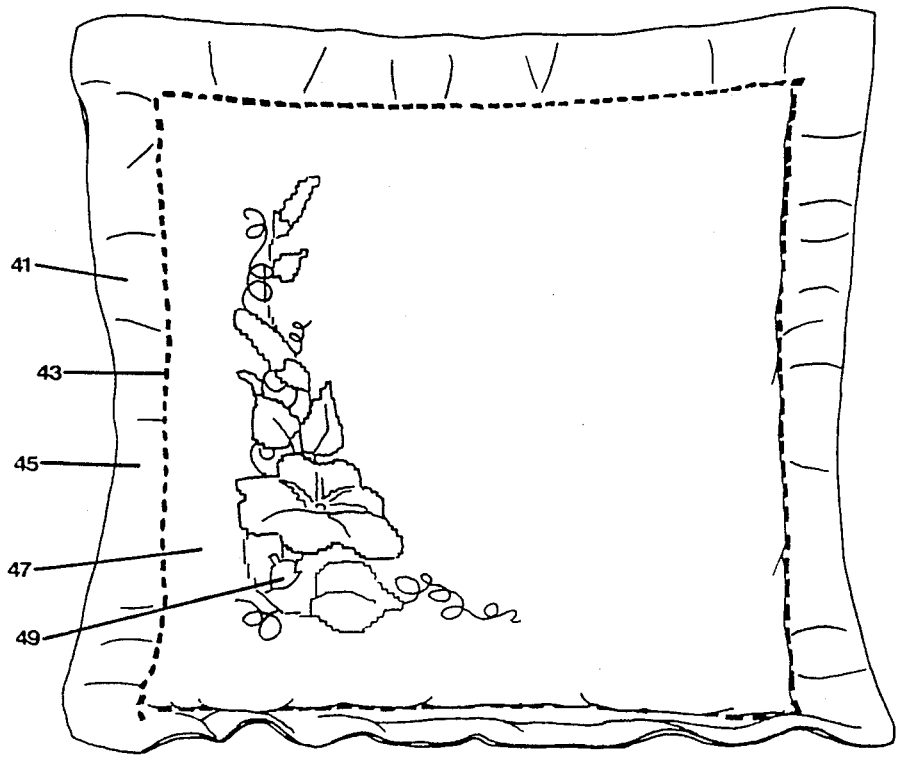
FIG. 2 illustrates the fabric of FIG. 1 formed into a pillow by the process of this invention.

The purpose of the discontinuities in the fabric in accordance with this invention is to define an area for hand embellishment therethrough about the central square or rectangle 19. Such may be better understood by referring to FIG. 2 of the drawings wherein a pillow 41 has been formed utilizing two pieces of fabric in accordance with this invention and joining the two pieces together about the discontinuities utilizing an embellishment 43 in so doing. It is seen from FIG. 2 that not only does the embellishment join the two pieces of fabric together to form the pillow, but defines a frame 45 about the central square or rectangle 47 thereof. It is further seen that the pillow 41 has been embellished at 49 and that such embellishment is framed by the frame 45.

Having generally set forth the concept of this invention, a description will now be had of the various fabrics and discontinuities therein utilizable within the scope of this invention.

Figure 3:
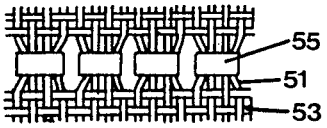
Figure 4:
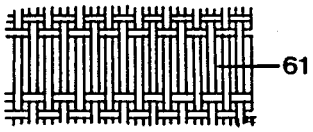

In one embodiment it is contemplated that the discontinuity will simply be missing threads or yarn in the direction of the discontinuity. FIG. 3 illustrates such a discontinuity 51 sourrounded by the generally continuous fabric 53. Also illustrated in FIG. 3 is an embellishing thread or ribbon 55 woven through the discontinuity 51. It is generally understood that such fabric may be produced by removing threads from a previously continuous woven fabric or by weaving the fabric with threads missing at the desired location. A particularly desireable process of producing the fabric and discontinuity in accordance with this invention is by utilizing a core yarn generally of the type described in U.S. Pat. No. 4,477,928 which is herewith incorporated by reference wherein the core yarn is of a greater diameter than the surrounding yarn and itself constitutes a discontinuity and which may be removed to leave a relic discontinuity such as illustrated in FIG. 4 of the drawing wherein a discontinuity 61 is in the form of a core yarn of greater diameter than the surrounding yarn and which may removed utilizing a tapestry needle.

Figure 6:
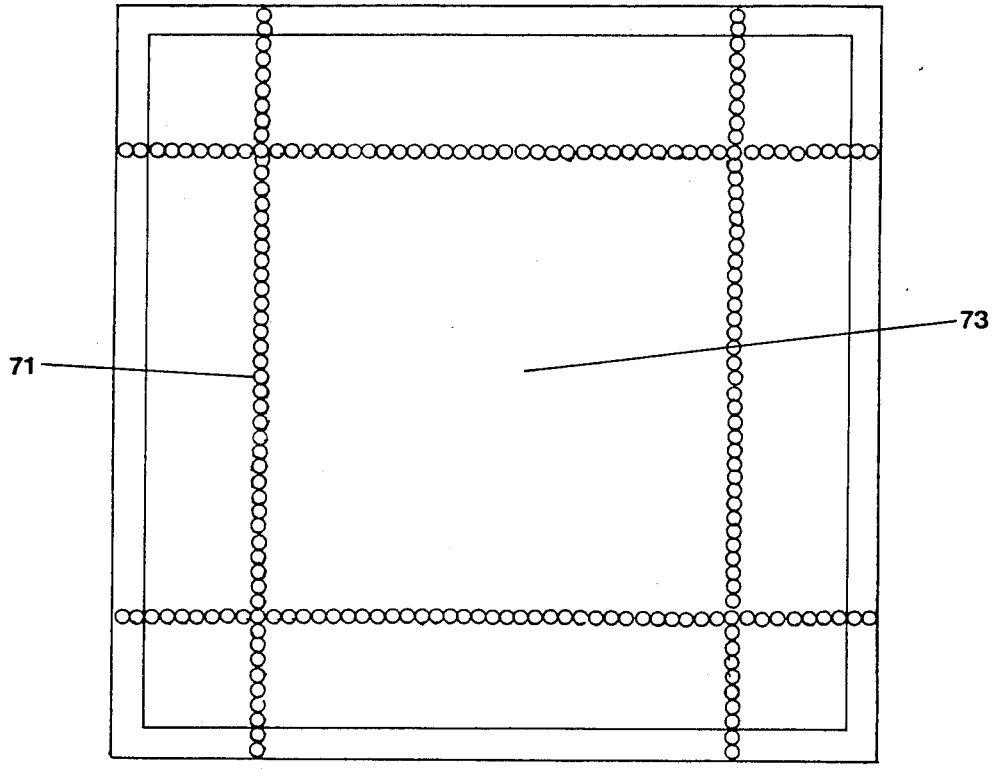

It is additionally contemplated that the fabric in accordance with this invention may have a discontinuity which is in essence stenciling about fabric which is capable of needle and thread embellishment. Such fabric in the case of stenciling may be any of the fabrics utilized for needle and thread embellishment such as that adapted for counted cross stitch, e.g., Aida-14. Additionally, it is contemplated that hemstitching could be utilized for form areas of discontinuity capable of embellishment and joining to similar fabrics. Such a fabric is illustrated in FIG. 6 wherein hemstitching 71 forms a discontinuity framing the central square or rectangle 73 thereof.

Figure 5:
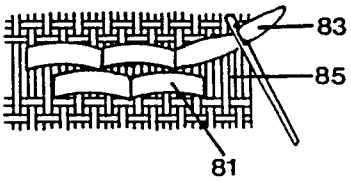

It is contemplated that a variety of embellishments may be woven through the discontinuities of the fabric of this invention. It is generally contemplated that ribbons, yarns, and threads may be woven through the discontinuity to embellish and generally frame the central square or rectangle. It is also contemplated that a plurality of embellishments may be woven through the discontinuity such as illustrated in FIG. 5 wherein two ribbons 81 and 83 are woven through the discontinuity 85. It is further contemplated that when a discontinuity having a core yarn is utilized that the core yarn could be of a material suitable for removal and reweaving through the relic discontinuity remaining. For example, a silk ribbon might be utilized as a core yarn which could be removed and then reused to be woven in a different manner through the relic discontinuity and particularly may be utilized to join similar sized fabrics by weaving through both discontinuities in the manner previously described for the formation of a pillow.

It is generally contemplated that consistent weave fabrics such as Aida-14 wherein the evenweave fabric creates interstices of equal distance in both the warp and weft directions so as to permit counted cross stitch. It is additionally contemplated that muslins and linens may be utilized within the scope of this invention. It is contemplated that the central square or rectangle may be embellished utilizing counted cross stitch, counted bead embroidery, embroidery, and stenciling. It is preferred that for craft marketing the fabric of this invention have a central square or rectangle which is of standard pillow size. In such event a standard pillow may be utilized as a stuffing between two superimposed pieces of fabric in accordance with this invention. The completed pillow is imply formed by hand embellishment through the discontinuities as previously described.

It is thus seen that the fabric of this invention provides a novel craft item which may be embellished and embellished to form a self-framing item and/or to form a pillow without need of mechanical devices. As many variations will become apparent to those of skill in the art from a reading of the above specification which is exemplary in nature such variations are embodied within the spirit and scope of this invention as defined by the following appended claims.

That which is claimed is:

1. A process for forming an embellished fabric comprising the steps of:

providing;

a woven flat fabric, said flat fabric having four (4) edges and being generally square or rectangular, a discontinuity near each said edge and parallel thereto and coextensive therewith, said discontinuity being of a core yarn of greater size than the yarn forming the bulk of the fabric to define a central square or rectangle within the center of said fabric and border areas along each said edge, removing said core yarns to leave a relic where said core yarn existed;

weaving an embellishment through said relic about said central square or rectangle.

* * * * *